US009182193B1

(12) United States Patent
Nerheim

(10) Patent No.: US 9,182,193 B1
(45) Date of Patent: Nov. 10, 2015

(54) SYSTEMS AND METHODS FOR PROVIDING A SIGNAL TO INHIBIT LOCOMOTION

(75) Inventor: Magne H. Nerheim, Paradise Valley, AZ (US)

(73) Assignee: TASER International, Inc., Scottsdale, AZ (US)

( * ) Notice: Subject to any disclaimer, the term of this patent is extended or adjusted under 35 U.S.C. 154(b) by 522 days.

(21) Appl. No.: 13/564,645

(22) Filed: Aug. 1, 2012

Related U.S. Application Data

(63) Continuation of application No. 12/343,811, filed on Dec. 24, 2008, now Pat. No. 8,254,080.

(51) Int. Cl.
*F41B 15/04* (2006.01)
*F41H 13/00* (2006.01)

(52) U.S. Cl.
CPC ..... *F41B 15/04* (2013.01); *F41H 13/0012* (2013.01)

(58) Field of Classification Search
CPC ..... F41B 15/04; F41H 13/0012
USPC ..... 361/232
See application file for complete search history.

(56) References Cited

U.S. PATENT DOCUMENTS

| | | | | |
|---|---|---|---|---|
| 3,958,168 | A | 5/1976 | Grundberg | |
| 5,754,011 | A | 5/1998 | Frus et al. | |
| 6,999,295 | B2 * | 2/2006 | Watkins, III | F41C 3/00 361/232 |
| 7,145,762 | B2 | 12/2006 | Nerheim | |
| 8,254,080 | B1 * | 8/2012 | Nerheim | 361/232 |
| 2007/0081292 | A1 | 4/2007 | Brundula | |
| 2008/0158769 | A1 | 7/2008 | Brundula | |
| 2008/0259520 | A1 | 10/2008 | Brundula | |
| 2008/0278882 | A1 * | 11/2008 | Saliga | 361/232 |
| 2008/0290730 | A1 | 11/2008 | Julicher | |

* cited by examiner

*Primary Examiner* — Zeev V Kitov
(74) *Attorney, Agent, or Firm* — D. Lawrence Letham

(57) ABSTRACT

An electronic weapon inhibits locomotion by a human or animal target by conducting a stimulus signal through the target. The electronic weapon includes an inductance, first and second energy stores, and a switch. The switch has a first position and a second position and is in series with first energy store and the inductance. Energy from the first energy store is transferred to a magnetic field of the inductance while the switch is operating in the first position. The stimulus signal comprises a first phase and a second phase. During the first phase, the switch is operated in the second position, and a flyback effect of the inductance provides an ionizing voltage for the stimulus signal. During the second phase, the second energy store releases energy for the stimulus signal at a voltage less than the ionizing voltage.

14 Claims, 4 Drawing Sheets

SYSTEMS AND METHODS FOR PROVIDING A SIGNAL TO INHIBIT LOCOMOTION

CROSS-REFERENCE TO RELATED APPLICATIONS

This application claims benefit under 35 U.S.C. §120 of U.S. Non-Provisional application Ser. No. 12/343,811 filed Dec. 24, 2008 to Nerheim, incorporated herein by reference.

BRIEF DESCRIPTION OF THE DRAWING

Embodiments of the present invention will be described with reference to the drawing, wherein like designations denote like elements, and.

DETAILED DESCRIPTION OF THE PREFERRED EMBODIMENTS

Figure 1:
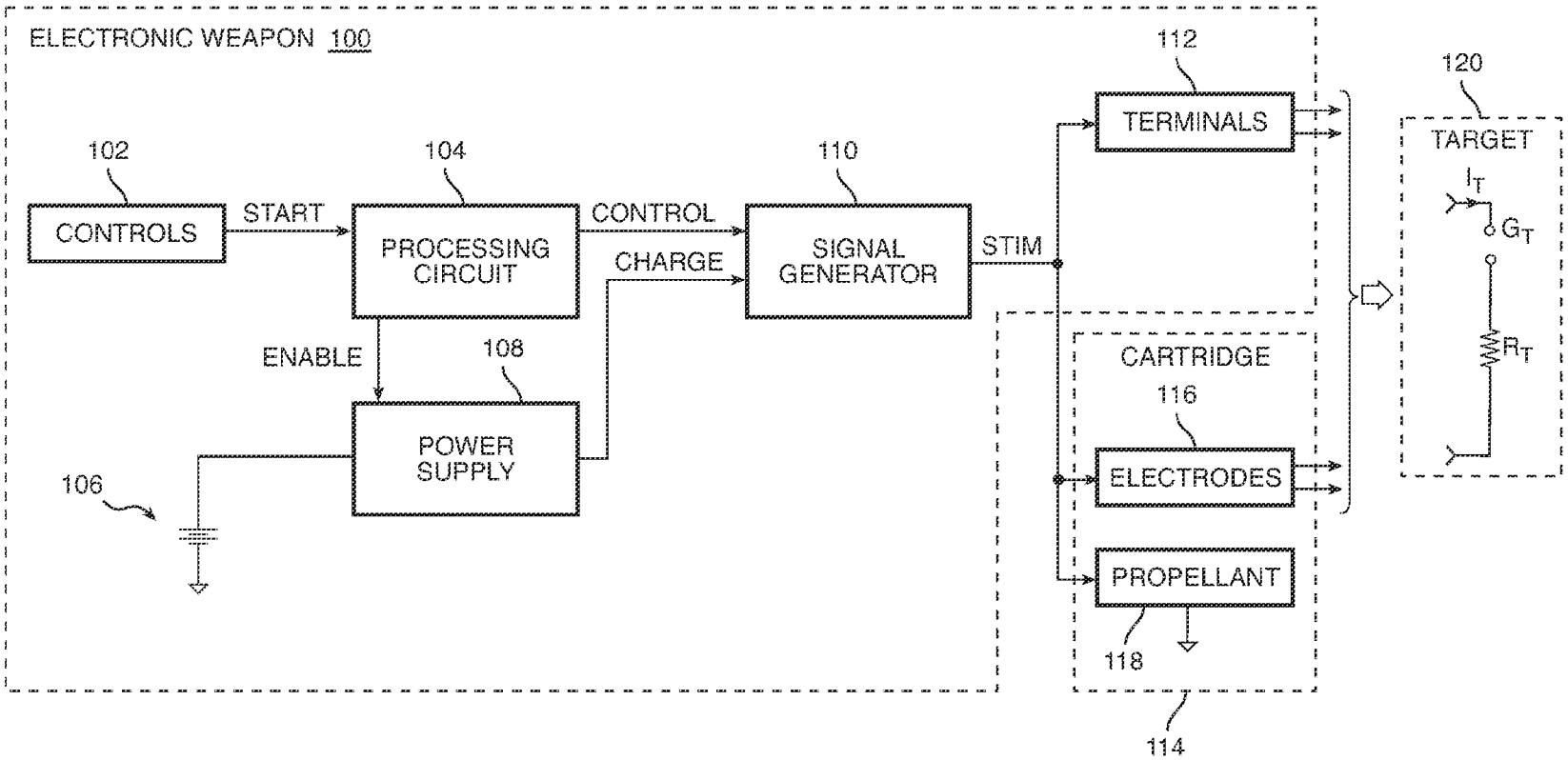
FIG. 1 is a functional block diagram of an electronic weapon according to various aspects of the present invention.

Electronic weapons apply an electric current to a human or animal target to interfere with locomotion by the target. For instance, a conventional electronic weapon may launch electrodes toward a target. The electrodes may be connected to the electronic weapon by tether wires. When the electrodes make contact with the target, a circuit is completed to pass a current through the target. The current typically includes pulses generated by a signal generator. The current is conventionally pulsed to avoid tissue damage (e.g., burns). The pulse width and repetition rate are conventionally selected to avoid serious injury (e.g., cardiac arrest) and to be sufficient to overpower the normal electrical signals transmitted over the nervous system of the target. Consequently, the target experiences pain and/or loses muscle control and its locomotion is inhibited either by pain or by skeletal muscle contractions caused by the current.

Electronic weapons include hand held devices having terminals that are held against a target (e.g., local stun), hand held devices that launch wire tethered electrodes to a target (e.g., remote stun), electrified projectiles that are propelled from firearms to a target, and stationary devices that implement these electronic weapon technologies (e.g., land mines, area denial devices). Electronic weapons also include conventional firearms having, in addition to conventional projectiles (e.g., bullets, gas, liquid, powder), a capability of conducting an electric current through a target.

An electronic weapon, according to various aspects of the present invention, provides, with improved efficiency, a current through a human or animal target to inhibit voluntary locomotion by the target. Such an electronic weapon may be of the type that launches one or more electrodes to contact the target or of the type that has terminals for manual positioning in contact with the target. In either type, one or more electrodes or terminals may be separated from target tissue by one or more gaps of various lengths (e.g., totaling a few inches or less). In an attempt to complete a circuit for current through the target, the electronic weapon may ionize air in each gap so that current can pass across each gap and through the target. Conventionally, a relatively high voltage (e.g., several kilovolts) is needed for ionizing.

Energy used to ionize air in one or more gaps to establish the circuit is not effective by itself to inhibit locomotion by the target. Generally, additional current must pass through the gap(s) and the target for a prescribed pulse width to accomplish inhibiting locomotion by the target. In the case where a finite amount of energy is available for ionizing and inhibiting, any energy used for ionizing reduces the amount of energy remaining for inhibiting locomotion by the target. The amount of energy provided through the target to inhibit locomotion may vary from one pulse to another when the amount of energy required for ionizing varies according to physical conditions (e.g., length of gap), and when the gap must be ionized between pulses of the current.

An electronic weapon, according to the various aspects of the present invention, has increased energy efficiency. Energy may be provided by an energy source (e.g., battery, charged capacitance, power supply).

An electronic weapon in the form of an electrified projectile generally includes in the launched projectile an energy source and a signal generator as a part of the projectile. On the other hand, an electronic weapon that establishes a circuit through a target using wire-tethered electrodes generally does not launch the energy source or the signal generator toward the target.

For example, electronic weapon 100 of FIG. 1, 2, 3A or 3B, and 4 cooperates with a cartridge 114 to propel electrodes 116 toward a target 120. The electronic weapon includes controls 102, processing circuit 104, battery 106, power supply 108, signal generator 110, and terminals 112. Cartridge 114 includes electrodes 116, propellant 118, and tether wires (not shown). Cartridge 114, a single shot cartridge, is installed with electronic weapon 100 and used for one deployment then removed and replaced. Multiple shot cartridges or magazines of single shot cartridges may be used.

Controls include switches operated by a user of electronic weapon 100. Controls may include a safety switch and a trigger switch. When the safety switch is off and the trigger switch is actuated, controls 102 provides a START signal to processing circuit 104. When the safety switch is on, actuation of the trigger switch has no effect.

A processing circuit includes any logic and/or timing circuitry that controls a power supply and a signal generator. In one implementation, processing circuit 104 comprises discrete logic responsive to the START signal to provide the ENABLE signal to control operation of power supply 108 and to provide the CONTROL signal to signal generator 110 to control generation of current through the target. In another implementation, processing circuit 104 includes a circuit that executes a program (e.g., a microprocessor, microcontroller, state machine) stored in memory (not shown) (e.g., semiconductor memory, magnetic memory) for the same functions and additional functions known in the art (e.g., keeping track of time and date, maintaining warranty information, recording a trigger usage log).

A power supply includes any circuit that supplies energy to be stored at relatively high voltage. For example, power supply 108 includes an oscillator operated from battery 106 and a step-up transformer for providing pulses at relatively high voltage for charging capacitors of signal generator 110. Power supply 108 operates while signal ENABLE is asserted by processing circuit 104.

A signal generator includes any circuit that generates a stimulus signal suitable for inhibiting locomotion of a human or animal target. A signal generator may store energy, convert energy from one form to another (e.g., electrical, magnetic), multiply a voltage, provide a current at a voltage, provide current as a pulse of current, provide a series of pulses of current having a repetition rate, provide a current at a voltage to ionize air in a gap, provide a current through an ionization path (e.g., one or more air gaps, spark gaps), provide a current to inhibit locomotion of a target that does not ionize air in a gap, and provide a current to inhibit locomotion of a target that sustains, but does not create, an ionization path. A signal generator may include a switch that initiates delivery of a current. A signal generator may form a circuit through a target via electrodes. For example signal generator 110 generates stimulus signal STIM comprising current pulses of from 4 to 200 microseconds pulse width, at a pulse rate of 5 to 40 pulses per second, and for a duration of stimulus from 5 to 30 seconds. In response to each assertion of signal CONTROL from processing circuit 104, signal generator 110 may provide one pulse. When signal generator 110 has pulse timing capability (e.g., provided by a spark gap), one duration of stimulus pulses at a desired repetition rate, for example 10 seconds duration of 15 pulses per second may be provided in response to each assertion of signal CONTROL. Each pulse may be capable of ionizing air in one or more gaps GT (e.g., up to a total length of 2 inches) that may exist between tissue of target 120 and either terminals 112 or electrodes 116.

The stimulus signal (e.g., STIM) is conducted through a target by terminals or by electrodes. For example, blunt terminals 112 are pressed against the target. Electrodes 116 having sharp barbed tips are propelled by propellant 118 toward the target and generally attach to target tissue or target clothing. Propellant 118 may include a powder charge activated by stimulus signal STIM to drive an anvil into a canister of compressed gas. The gas released from the canister propels the electrodes, for example, 15 to 35 feet. Each electrode continues to be coupled to electronic weapon 100 via a trailing tether wire (not shown). Terminals are generally spaced apart by a distance sufficient for a pain compliance inhibition of locomotion (e.g., 1 to 4 inches). Electrodes are generally spaced apart by a distance sufficient for contraction of skeletal muscles that inhibits locomotion (e.g., greater than about 7 inches). Current through the target flows from one terminal to another terminal; or from one electrode to another electrode.

An electrode couples to a target to provide a current through the target. An electrode may contact target tissue or lodge near target tissue. A gap of air may separate an electrode from target tissue. Air in a gap between an electrode and target tissue may be ionized to establish an ionization path for current flow from the electrode through the target. Current from an electronic weapon may flow through a target for a duration that an ionization path exists. Air in a gap may be ionized by applying a relatively high voltage across the gap. The term gap is used to refer to a spark gap component or mechanical feature of an electronic weapon and/or cartridge; and/or a distance between a terminal or electrode and target tissue.

A target includes a human or animal target. A target provides an impedance to a stimulus current. A stimulus current through a target is generally proportional to the voltage associated with the current and inversely proportional to the impedance of the target. For stimulus signals suitable for inhibiting locomotion, target impedance may be represented as a resistance. For example, target 120 includes resistance RT (e.g., about 300 ohms) and may include gap GT. When an electrode or terminal is in contact with target tissue and while an ionized path exists, gap GT has a very low resistance (e.g., less than 1 ohm). A human or animal target 120 may be modeled as a resistance in series with an air gap. The resistance RT models the resistance traversed by a current flowing between terminals or electrodes. The air gap GT models all air gaps (if any) ionized to conduct the current through the target (e.g., from an electrode tip lodged in clothing to target tissue). An electronic weapon, according to various aspects of the present invention, may include a signal generator that uses an inductance for voltage multiplication by a flyback effect to ionize air in a gap GT to establish an ionization path. In such an implementation, other components of the signal generator may provide, after ionization, energy for additional current through the target resistance RT via the ionization path. An electronic weapon may further deliver through target resistance RT, according to various aspects of the present invention, a stored energy that is not subject to some of the losses of the inductance (e.g., imperfect coupling between windings).

A battery operated electronic weapon uses voltage multiplication to generate voltages (e.g., for ionizing air) on the order of several tens of kilovolts and to generate voltages (e.g., for nervous system stimulation) on the order of several hundred volts.

A signal generator may include a transformer to multiply a voltage. A transformer may multiply a voltage in such a manner that the voltage is sufficient to ionize air in a gap so that a current may traverse the gap. Voltage multiplication may result from a step-up ratio of primary to secondary windings of the transformer.

A signal generator may include an inductance (e.g., flyback transformer, flyback inductor, buck-boost inductor) to multiply a voltage. Voltage multiplication in a winding of the inductance may result from suddenly changing (e.g., interrupting) a current through the inductance. The application and interruption of current through such an inductance may be called a switching cycle involving discontinuous modes of operation (e.g., magnetizing mode, demagnetizing mode). According to a flyback effect, voltage at a relatively high absolute value results from the collapse of a magnetic field in the core of the inductance.

In an implementation using a flyback transformer, the transformer receives a current at a first voltage via a primary winding, converts the current into a magnetic field, stores the energy of the magnetic field in the transformer core. When the current in the primary winding is interrupted, the flyback transformer transfers the energy of the magnetic field to the secondary winding (e.g., at a step up according to the winding turns ratio) at a relatively high voltage boosted by the flyback effect. The relatively high voltage across the secondary winding is used to ionize air in one or more gaps (e.g., up to a total length of 2 inches) that may exist between tissue of a target and either terminals or electrodes. After a suitable duration of collapsing magnetic field, the primary current may be reapplied. Discontinuous operation of the flyback transformer occurs when a current flow through the primary winding is interrupted. When the ionization path is established through the gap, the remaining portion of the energy in the secondary winding and any additional energy sources in the circuit are expended as a current that flows through the target via the ionization path. When the energy of the secondary winding and other energy sources in the circuit are expended in ionization and providing a current, the ionization path dissipates thereby terminating the circuit through the target. A next delivery of current through the target generally requires that the air in the gap be ionized anew to establish an ionization path for current delivery.

Stored energy that is not used for ionization may be provided through a target via an ionization path that is already ionized. For example, energy from a flyback transformer may ionize air in a gap and provide some amount of energy through a target via the ionization path, while, according to various aspects of the present invention, another source of stored energy is provided through the target after ionization.

Figure 2:
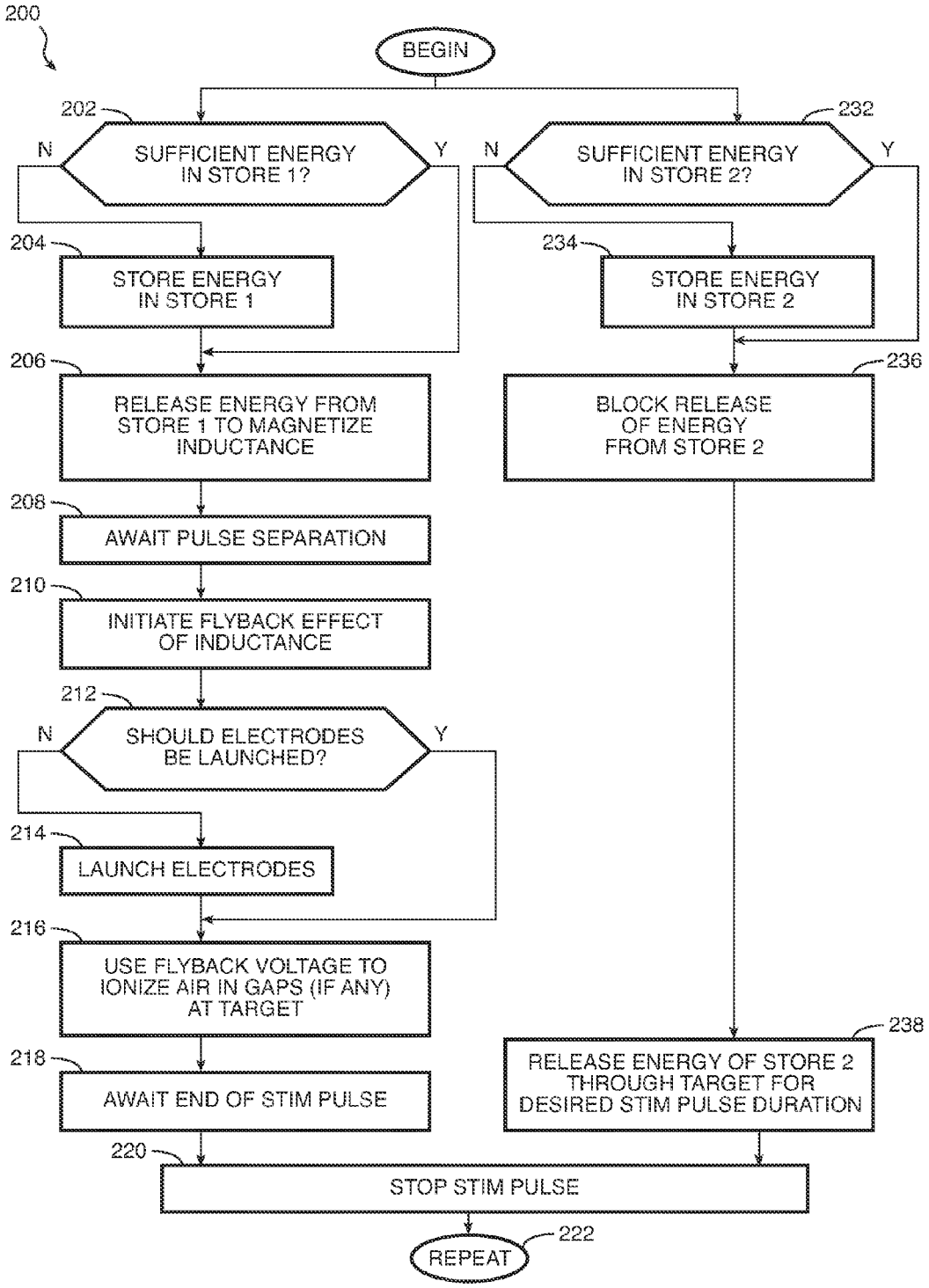
FIG. 2 is a flow chart of a method performed by the electronic weapon of FIG. 1.

A method 200 of FIG. 2 performed by an electronic weapon 100 more efficiently accomplishes inhibiting locomotion of a target 120. The method includes a loop for generating each pulse of a stimulus signal STIM. The loop includes two parallel execution paths. The first path (202-218) charges and discharges a first energy store STORE1 while the second path (232-238) charges and discharges a second energy store STORE2. The two paths may execute in parallel. At the top of the loop, a test (202) is made for sufficient energy in STORE1. If not sufficient, additional energy is stored (204) in STORE1; otherwise, additional storing is omitted. Energy store STORE1 may store sufficient energy for one or more executions of the first path. Energy from energy store STORE1 is released (206) to magnetize an inductance (e.g., part of signal generator 110). Consecutive pulses of the stimulus signal STIM are separated by a desired period to accomplish a desired pulse repetition rate (e.g., from 5 to 40 pulses per second). After magnetizing the inductance, processing awaits (208) lapse of the period between pulses. After lapse of the period, a flyback voltage is initiated (210) in the inductance. For example, a current that has maintained magnetization is suddenly changed (e.g., interrupted). A test (212) is made to determine if electrodes should be launched. If so, a pair of wire-tethered electrodes is launched (214) toward target 120 in any conventional manner. When the flyback voltage of the stimulus signal STIM is used to activate propellant 118, electrodes are launched in response to the first pulse of a stimulus signal. If terminals for local stun are being used instead of electrodes for remote stun, or if electrodes were already launched, pulses of stimulus signal STIM are produced without launching electrodes. A flyback voltage is then used to ionize gaps GT, if any, at target 120. The flyback voltage may be used to initiate the release of energy of STORE2 (238) discussed below. After ionizing, processing may simply await (218) the end of the stimulus signal STIM pulse that began with ionizing. At the end of the desired pulse duration, the stimulus pulse is stopped (220). If additional pulses are desired, process 200 is repeated (222). Pulses may be repeatedly produced for a duration of from 5 to 30 seconds.

The duration of a stimulus signal STIM pulse may be designed to consistently be one value from 4 to 200 microseconds for each pulse of the stimulus signal. Energy may be conserved by decreasing pulse repetition rate as the stimulus signal proceeds.

When there is insufficient energy in energy store STORE2 (232), additional energy is stored (234) in energy STORE2. After a desired total energy is stored, the release of energy from energy store STORE2 may be blocked (236). Blocking release allows time for storing energy in energy store STORE1 (204), magnetizing (206) the inductance, awaiting (208) pulse separation, initiating (210) the flyback voltage, launching (214) electrodes, and ionizing air (216). During ionizing or after ionizing (216) is accomplished, energy from energy store STORE2 is released (238) through target 120 for the desired duration of one stimulus signal STIM pulse. After a suitable STIM pulse duration or substantial depletion of energy from energy store STORE2, the stimulus signal STIM pulse is stopped (220). Another stimulus signal STIM pulse is produced by repeating method 200.

Stopping the delivery of current of a stimulus signal STIM pulse may be accomplished by failing to maintain the ionization of air in a gap (e.g., a gap used as a control component in electronic weapon 100, a gap in cartridge 114, a gap GT at target 120). In another implementation electronic weapon 100 includes a switch that is operated to stop delivery of current for a stimulus signal pulse. Such a switch may include a voltage controlled switch. A spark gap having a breakover voltage is an example of a simple voltage controlled switch. Semiconductor switches may be used.

An energy store receives energy, stores energy, and delivers energy, where receiving and delivering are generally at different times. An energy store may include a capacitance (e.g., one or more capacitors) and/or an inductance (e.g., one or more inductors, transformer windings, transformers). An energy store may receive energy in any form (e.g., current, voltage, magnetic field). An energy store may convert energy to a different form for delivery.

An inductance that provides a flyback voltage may be implemented as a flyback transformer that includes a primary winding and a secondary winding. Such a flyback transformer receives energy in the form of a current in a primary winding, converts the energy to a magnetic field in the core of the transformer, and transfers the energy stored in the magnetic field to a secondary winding. A voltage across the secondary winding may be increased significantly by interrupting current flow in the primary winding, as discussed above. A flyback transformer may be wound as an autotransformer.

An inductance (e.g., one or more inductors) that is magnetized with a current of a first magnitude may exhibit a flyback voltage when the current magnitude is suddenly and substantially changed (e.g., interrupted, reduced, increased). Changing the magnitude of the magnetizing current may be accomplished using any conventional switch to configure the inductance to drive a load impedance with the energy of the collapsing magnetic field. If the load impedance is relatively high (e.g., near infinite for a gap prior to ionizing) a relatively high flyback voltage will result across the inductance.

A switch controls current in components that are in series with the switch. A switch may exercise such control in response to a voltage across the switch and/or a control signal. Switches include mechanical (e.g., relay, reed switch) and electronic (e.g., MOSFET, JFET, SCR). The control signal may be provided by a timer or by a timing function performed by a logic circuit or processing circuit.

A signal generator, power supply, and processing circuit may cooperate to perform method 200. For example, signal generator 110 of FIGS. 1 and 3A or 3B, according to various aspects of the present invention, ionizes air in a gap (e.g., GS, GT) and provides energy through a target 120 via the resulting ionization path in response to signals ENABLE and CONTROL timed by processing circuit 104. Signal generator 110 of FIG. 3A includes a first energy store implemented with diode D1 and capacitor C1, a second energy store implemented with diode D2 and capacitor C2, a flyback transformer T1 including a primary winding W1 and a secondary winding W2, a switch Q1 representing any type of switch, and an output circuit that includes diode D3 and spark gap GS. A stimulus signal STIM, as discussed above, is produced across the output of signal generator 110 (e.g., the output of electronic weapon 100 to terminals 112 or to cartridge 114) having a positive voltage to circuit common. A second terminal or electrode is coupled to circuit common to complete a circuit through target 120.

Processing circuit 104 provides signal ENABLE to power supply 108 to enable timely provision of signals CHARGE-A and CHARGE-B. Processing circuit 104 also provides signal CONTROL for desired pulse duration (pulse width) and pulse separation (repetition rate) for stimulus signal STIM.

Signal CHARGE-A provides energy to be stored in capacitor C1 while switch Q1 is substantially nonconducting (e.g., open) as directed by signal CONTROL. Signal CHARGE-B provides energy to be stored in capacitor C2. The charging voltages (and voltages associated with sufficient charging) may differ between capacitors C1 and C2. Release of energy from capacitor C2 is blocked by spark gap GS until the breakover voltage of spark gap GS is reached. Signal CHARGE B is insufficient to build a voltage on capacitor C2 to reach the breakover voltage of spark gap GS. When switch Q1 is substantially conducting (e.g., closed) energy from capacitor C1 magnetizes the core of transformer T1 at the decreasing voltage of capacitor C1. Energy from signal CHARGE-A may assist magnetizing the core. When switch Q1 is suddenly opened (e.g., a relatively high impedance) as directed by signal CONTROL, the magnetic field in the core of transformer T1 causes a relatively high voltage to appear across winding W2 according to the flyback effect discussed above. The combined voltage of capacitor C2 and winding W2 (e.g., a boosted voltage) exceeds the breakover voltage of gap GS and provides stimulus signal STIM with an initial high voltage for ionizing air in any gaps GT that may exist with respect to a particular target 120. Capacitor C2 discharges to provide energy for the duration of one stimulus signal STIM pulse. Generally, energy from the core of transformer T1 dissipates more quickly than the energy from capacitor C2. When discharging of capacitor C2 is insufficient to maintain ionization in any gap (e.g., GS, GT), delivery of stimulus current stops.

Figure 3A:
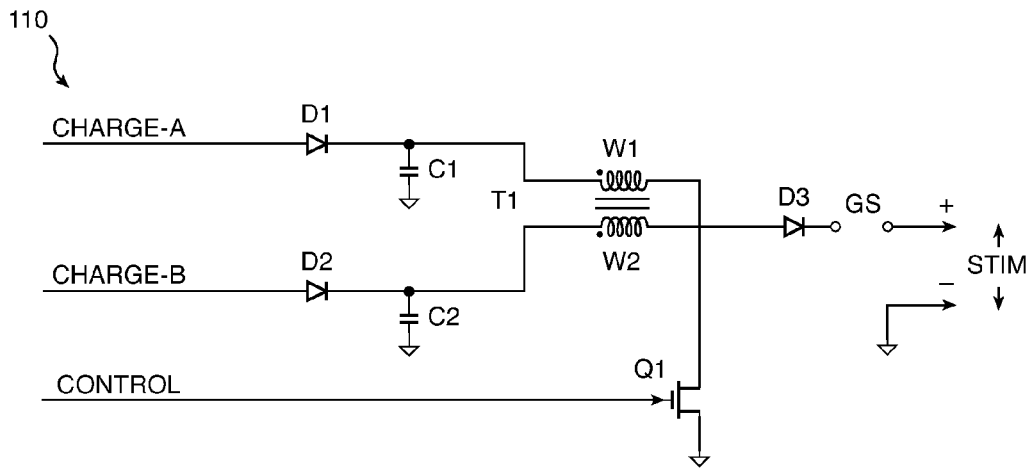
FIG. 3A is a schematic diagram of an exemplary implementation of the signal generator of FIG. 1.
Figure 3B:
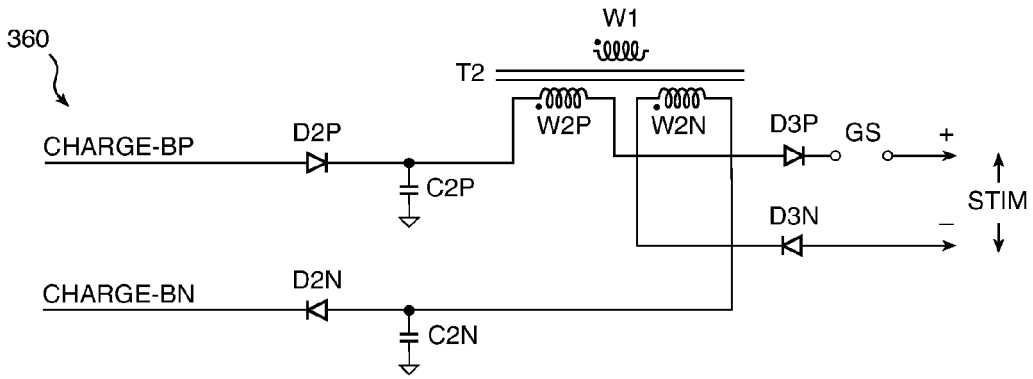
FIG. 3B is a schematic diagram of another implementation of the signal generator of FIG. 1.
Figure 4:
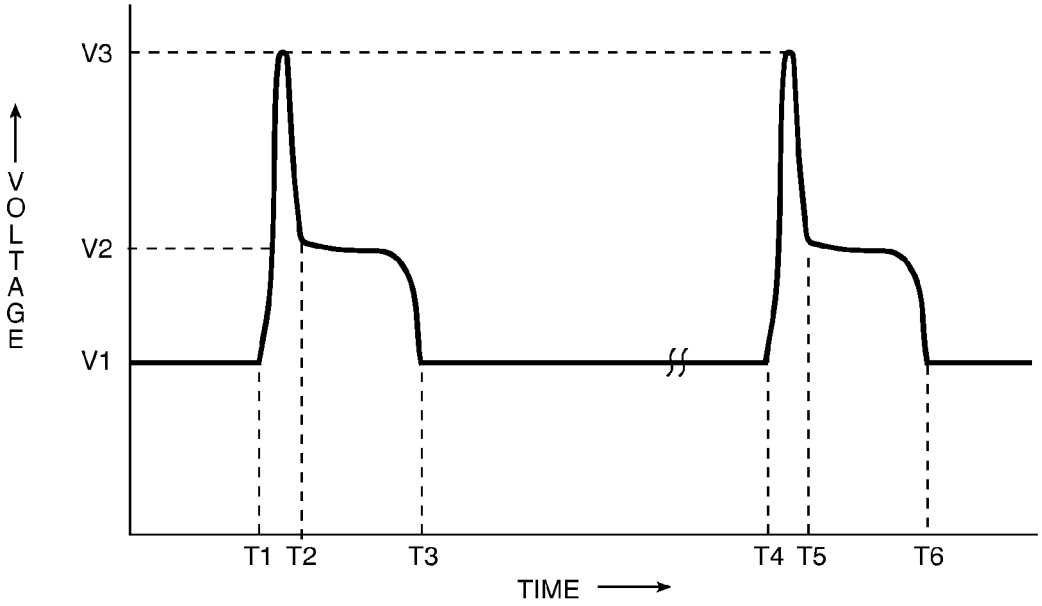
FIG. 4 is a timing diagram of a stimulus signal of the electronic weapon of FIGS. 1, 2, 3A, and 3B.

In another implementation of signal generator 110, stimulus signal STIM is provided as positive and negative voltages instead of a positive voltage to circuit common as discussed above. For example, secondary circuit consisting of diode D2, capacitor C2 winding W2, and diode D3 is replaced using the technology described in FIG. 3B. In FIG. 3B, positive (P) and negative (N) components are identified with suffix letters. Windings 2P and 2N may be identical in number of windings. Use of the technology described in FIG. 3B may reduce the size, weight, and cost of signal generator 110; and may provide greater safety to a user of electronic weapon 100. For example, a 50 KV ionization voltage of stimulus signal STIM is provided with +25 KV and −25 KV with respect to circuit common.

A stimulus signal, according to various aspects of the present invention, includes an ionizing phase and a nervous system stimulating phase. The nervous system stimulus phase may cause pain in a human or animal target or cause skeletal muscle contractions in the target, depending on the duration of the phase. For example, stimulus signal STIM of FIG. 4 as discussed above may include ionizing phase from time T1 to time T2 in a first pulse and from time T4 to time T5 in a subsequent pulse. Stimulus signal STIM may further include a nervous system stimulating phase from time T2 to time T3 in the first pulse and from time T5 to time T6 in a subsequent pulse. The pulse width may include both phases, that is from time T1 to time T3. In another implementation, the polarity of the ionizing phase is opposite from the polarity of the nervous system stimulating phase. Opposite polarity may lead to pulse generating circuits that are smaller, lighter weight, or have lower manufacturing costs. The pulse width may include only the time of the nervous system stimulating phase, from time T2 to time T3. In yet another implementation, the polarity of the stimulating phase alternates among consecutive pulses with similar or opposite ionizing phase voltages. Altering the polarity of the stimulating phase may beneficially decrease risk of cardiac muscle response to the stimulating phase of the stimulus signal. The voltage of stimulus signal STIM during an ionizing phase (e.g., V3) may be from about 6 kilovolts to about 50 kilovolts from a reference voltage (e.g., V1) of about zero volts with any suitable polarity. The voltage of stimulus signal STIM during a nervous system stimulus phase (e.g., V2) may be from about 300 volts to about 6 kilovolts from a reference voltage (e.g., V1) with any suitable polarity.

An electronic weapon, according to various aspects of the present invention, inhibits locomotion by a human or animal target by conducting a stimulus signal through the target. The electronic weapon includes an inductance, first and second energy stores, and a switch. The switch has a first position and a second position and is in series with first energy store and the inductance. Energy from the first energy store is transferred to a magnetic field of the inductance while the switch is operating in the first position. The stimulus signal comprises a first phase and a second phase. During the first phase, the switch is operated in the second position, and a flyback effect of the inductance provides an ionizing voltage for the stimulus signal. During the second phase, the second energy store releases energy for the stimulus signal at a voltage less than the ionizing voltage.

A method, performed by an electronic weapon, inhibits locomotion by a human or animal target by passing a stimulus signal through the target. The method includes the following steps performed in any practical order: (a) storing energy in a first energy store of the electronic weapon; (b) releasing energy form a first energy store to magnetize an inductance of the electronic weapon; (c) storing energy in a second energy store of the electronic weapon; (d) initiating a flyback effect of the inductance to generate a flyback voltage; (e) supplying a stimulus signal from the electronic weapon in a first phase responsive to the flyback voltage to ionize air in a gap in series between the electronic weapon and the target; (f) releasing energy from the second energy store to supply the stimulus signal in a second phase from energy released from the second energy store to accomplish a pulse width that causes pain or skeletal muscle contractions in the target; and (g) repeating the method to provide a plurality of pulses to accomplish inhibiting locomotion by the target.

The implementations of the present invention discussed above may include any of the teachings of the following U.S. Pat. Nos. 7,075,770, 7,145,762, and 7,057,872, each incorporated herein by reference.

The foregoing description discusses preferred embodiments of the present invention, which may be changed or modified without departing from the scope of the present invention as defined in the claims. The examples listed in parentheses may be alternative or combined in any manner. The invention includes any practical combination of the structures and method steps disclosed. While for the sake of clarity of description several specifics embodiments of the invention have been described, the scope of the invention is intended to be measured by the claims as set forth below.

What is claimed is:

1. A method for inhibiting locomotion by a human or animal target by providing a stimulus signal through the target, the method performed by an electronic weapon, the method comprising:

providing a first portion of the stimulus signal to ionize air in a gap between an electrode of the electronic weapon and the target, an energy of the first portion provided substantially by a collapse of a magnetic field in an inductor of the electronic weapon; and providing a second portion of the stimulus signal after ionization of the air in the gap, an energy of the second portion provided substantially by a discharge of a first capacitance of the electronic weapon, the energy of the second portion causes pain or skeletal muscle contractions in the target to inhibit locomotion of the target.

2. The method of claim 1 wherein providing the first portion comprises generating a flyback voltage in the inductance.

3. The method of claim 1 wherein:

the inductance comprises a transformer having a primary winding and a secondary winding; and providing the first portion comprises interrupting a current in the primary winding to initiate a flyback voltage in the secondary winding, the flyback voltage for ionizing the air in the gap.

4. The method of claim 3 wherein the secondary winding has more turns than the primary winding that contributes to a magnitude of the ionizing voltage.

5. The signal of claim 1 wherein:

the inductance comprises a transformer having a primary winding and a secondary winding;

a second capacitance releases energy into the primary winding but not during the first portion of the signal; and the secondary winding provides a voltage during the first portion to ionize air in the gap.

6. An electronic weapon for providing a first portion and a second portion of a stimulus signal to produce skeletal muscle contractions in a target to inhibit locomotion by the target, the electronic weapon for use with at least one provided electrode, the electronic weapon comprising:

a transformer having a primary winding, a first secondary winding, and a second secondary winding;

a switch in series with the primary winding;

a first capacitance having a first charge, the first capacitance in parallel with the primary winding;

a second capacitance having a second charge, the second capacitance in series with the first secondary winding; and a third capacitance having a third charge, the third capacitance in series with the second secondary winding; wherein:

responsive to opening the switch to interrupt a discharge of the first charge into the primary winding, the first and second secondary windings provide the first portion of the stimulus signal to ionize air in a gap between the electrode and the target to establish a circuit through the target; and responsive to ionizing air in the gap, the second capacitance and the third capacitance discharge the second charge and the third charge respectively to provide the second portion of the stimulus signal through the target via the circuit to produce skeletal muscle contractions in a target to inhibit locomotion by the target.

7. The electronic weapon of claim 6 wherein a voltage of the second charge and a voltage of the third charge respectively is less than a voltage of the first portion of the stimulus signal.

8. The electronic weapon of claim 6 further comprising a spark gap having a breakover voltage, wherein:

the spark gap couples at least one of the first secondary winding and the second secondary winding to the target; and the breakover voltage is less than a voltage of the first portion of the stimulus signal.

9. The electronic weapon of claim 8 wherein the second capacitance and the third capacitance cannot provide the second portion of the stimulus signal until ionization of the spark gap by the first portion of the stimulus signal.

10. A method for inhibiting locomotion by a human or animal target by providing a current through the target, the method performed by an electronic weapon, the method comprising:

releasing energy from a first energy store of the electronic weapon to establish a magnetize field in an inductance of the electronic weapon;

initiating a collapse of the magnetic field of the inductance to generate a flyback voltage to ionize air in a gap between the electronic weapon and the target to establish a circuit through the target;

responsive to ionizing air in the gap, releasing energy from a second energy store of the electronic weapon to provide a pulse of the current via the circuit, the pulse causes pain or skeletal muscle contractions in the target; and repeating initiating and releasing to provide a plurality of pulses to inhibit locomotion of the target.

11. The method of claim 10 wherein initiating comprises stopping the release of energy from the first energy store to generate the flyback voltage.

12. The method of claim 10 wherein a duration of the pulse continues until the energy released from the second energy store cannot maintain an ionization path between the electronic weapon and the target.

13. The method of claim 10 wherein releasing energy from the second energy store occurs responsive to establishing the circuit.

14. The method of claim 10 wherein a magnitude of a voltage of the energy of the second energy store is less than a magnitude of the flyback voltage.

* * * * *